US007239711B1

(12) United States Patent
Andersen et al.

(10) Patent No.: US 7,239,711 B1
(45) Date of Patent: Jul. 3, 2007

(54) HEARING AID SYSTEM AND HEARING AID FOR IN-SITU FITTING

(75) Inventors: Henning Andersen, Birkerød (DK); Kim Hjortgaard Nielsen, Vipperød (DK)

(73) Assignee: Widex A/S, Vaerlose (DK)

( * ) Notice: Subject to any disclaimer, the term of this patent is extended or adjusted under 35 U.S.C. 154(b) by 0 days.

(21) Appl. No.: 09/744,300

(22) PCT Filed: Jan. 25, 1999

(86) PCT No.: PCT/DK99/00034

§ 371 (c)(1),
(2), (4) Date: Jan. 23, 2001

(87) PCT Pub. No.: WO00/44198

PCT Pub. Date: Jul. 27, 2000

(51) Int. Cl.
*H04R 29/00* (2006.01)

(52) U.S. Cl. ..... 381/60; 381/312

(58) Field of Classification Search ..... 381/60, 381/315, 120, 104, 109, 321, 106, 312, 62; 600/559; 330/251, 207 A
See application file for complete search history.

(56) References Cited

U.S. PATENT DOCUMENTS 3,818,149 A 6/1974 Stearns et al.
4,471,171 A 9/1984 Kopke et al.
4,959,867 A * 9/1990 Lutz ..... 381/107
5,012,520 A * 4/1991 Steeger ..... 381/315
5,168,556 A 12/1992 Lajtai et al.
5,266,919 A * 11/1993 Cook et al. ..... 340/384.7
5,321,758 A * 6/1994 Charpentier et al. ..... 381/317
5,378,933 A 1/1995 Pfannenmueller et al.
5,696,833 A * 12/1997 Matzen et al. ..... 381/60
5,701,106 A * 12/1997 Pikkarainen et al. ..... 332/100
5,710,819 A 1/1998 Topholm et al.
5,710,820 A * 1/1998 Martin et al. ..... 381/321
5,881,159 A * 3/1999 Aceti et al. ..... 381/328
6,048,305 A * 4/2000 Bauman et al. ..... 600/25
6,118,877 A * 9/2000 Lindemann et al. ..... 381/60

(Continued)

FOREIGN PATENT DOCUMENTS

DE 32 05 685 A1 8/1983

(Continued)

*Primary Examiner*—Vivian Chin
*Assistant Examiner*—Corey Chau
(74) *Attorney, Agent, or Firm*—Sughrue Mion, PLLC

(57) ABSTRACT

Hearing aid system for the in-situ fitting of hearing aids, said system comprising a separate control device, and a least one hearing aid, adapted for communication with each other, said hearing aid comprising at least one microphone, a signal processor for generating an output signal to a receiver, and means for receiving control signals form the control device. During the in-situ fitting the control device is in communication with said hearing aid for the activation of generation of test signals, which test signals are delivered to said receiver and emitted therefrom as acoustic test signals. Further, the hearing aid comprises a switch means which when said hearing aid is in communication with the control device may optionally be switched between at least a first and a second position, said switch attenuating in the first position the output signal to the receiver using a voltage dividing resistor network, and said switch bypassing in the second position said voltage dividing resistor network so as not to influence the output signal to the receiver.

14 Claims, 6 Drawing Sheets

U.S. PATENT DOCUMENTS

| | | | | |
|---|---|---|---|---|
| 6,173,063 | B1 * | 1/2001 | Melanson | 381/318 |
| 6,330,339 | B1 * | 12/2001 | Ishige et al. | 381/312 |
| 6,442,279 | B1 * | 8/2002 | Preves et al. | 381/72 |

FOREIGN PATENT DOCUMENTS

| | | | |
|---|---|---|---|
| EP | 0 335 542 | A2 | 10/1989 |
| EP | 0 360 917 | A1 | 4/1990 |
| EP | 0 563 421 | A1 | 10/1993 |
| JP | 56004814 | | 1/1981 |
| JP | 115890 | | 6/1989 |
| JP | 03-248635 | | 11/1991 |
| JP | 05250058 | | 9/1993 |
| JP | 07 079765 | | 3/1995 |
| JP | 10-229598 | | 8/1998 |
| WO | WO 96/17493 | | 6/1996 |
| WO | WO 97/14267 | | 4/1997 |
| WO | WO 98/47314 | | 10/1998 |

* cited by examiner

HEARING AID SYSTEM AND HEARING AID FOR IN-SITU FITTING

BACKGROUND OF THE INVENTION

The present invention relates to a hearing aid system for the in-situ fitting of hearing aids.

For persons with a hearing loss, the sensitivity of the ear will often be frequency dependent within the usual audible range, ie. the person may have almost normal sensitivity at certain frequencies, but a low sensitivity at others.

Since the object of the hearing aid is to give normal hearing at all frequencies, the amplification provided by the hearing aid must as a result also be frequency dependent, with a high amplification at frequencies where hearing sensitivity is low and zero or low amplification where hearing is normal or close to normal.

Because hearing losses vary from person to person the frequency dependency or amplification characteristic for the hearing aid should be adjustable, so that the hearing aid can be fitted to the actual hearing loss of the person.

One way is to separately measure an audiogram for the patient, ie. measuring sensitivity of the ear to different frequencies and sound pressures, using a test signal generator and a headphone, and adjust the settings of the hearing aid accordingly based on the audiogram.

Another way is the in-situ fitting where the audiogram is measured with the hearing aid placed in the ear and acting as an audio signal source instead of the headphone. This is described in eg. U.S. Pat. No. 5,710,819.

In the in-situ fitting procedure the hearing aid is coupled to an external control device, with which a generation of test signals for the receiver, ie. the output transducer of the hearing aid can be activated. The test signals may either be generated in the control device and delivered to the hearing aid, or they may be generated in the hearing aid in accordance with control signals from the control device. In both cases the built-in amplifier of the hearing aid is used to achieve the different levels for the test signals, and hence the output sound levels from the receiver. The control device further may further provide the power for the hearing aid during the fitting procedure.

Even though the use of the hearing aid itself in the fitting procedure has advantages, such as higher accuracy in the fitting of the frequency characteristic compared to the fitting using a separate audiogram, it does have some drawbacks.

One major drawback is that a very high dynamic output range for the acoustic test signals is needed for the fitting procedure.

This dynamic range is expressed as the difference between the maximum output level achievable and the inherent noise level in the amplifier.

The reason that this very high dynamic range is needed is that the amplifier on one hand should be able to deliver signals powerful enough to make the sounds output by the receiver exceed the hearing threshold for persons with severe hearing losses, eg. above 130 dB SPL (Sound Pressure Level). On the other hand, when measuring on persons with normal hearing in at least certain frequency ranges very low sound output levels are needed, and in such cases the inherent amplifier noise should not exceed the level of the test signal. The latter requiring that the amplifier noise does not exceed approximately 10 dB SPL.

Hence, the necessary dynamic range of the amplifier should exceed 120 dB if the hearing aid is to be fitted in-situ on any person with an unspecified hearing loss.

In fact, if the same amplifier is to be used in different hearing aids of different construction, in particular with different receivers having different responses, the dynamic range should be even higher, eg. 140 dB.

This dynamic range of 140 dB is far more than the dynamic range of 60-80 dB needed under normal circumstances when the hearing aid is used.

Achieving these high dynamic ranges is complex and costly in hardware, and would increase the costs of the amplifier and thus of the hearing aid, whereas lower dynamic ranges of say 90 to 100 dB are readily achieved with both analogue and digital amplifiers. For instance this higher dynamic range would normally in digital hearing aids require a higher number of bits to achieve the higher resolution.

From U.S. Pat. No. 3,818,149 and U.S. Pat. No. 5,321,758 it is known to attenuate the output signal from the final stage in analogue amplifiers by means of resistor components. However, none of these hearing aids are adapted for in-situ fitting, and hence do not have a need for the mentioned large dynamic range.

In U.S. Pat. No. 3,818,149 the attenuation of the analogue signal is done for the purpose of volume control by means of a voltage divider in the form of an adjustable potentiometer. Having such a voltage divider as the final stage before the receiver leads to increased power consumption. Power consumption is an important issue in hearing aids, in particular because these of aesthetic reasons are small, leaving little room for batteries. Having such a voltage divider in the output circuit of a hearing aid is therefore undesirable.

In U.S. Pat. No. 5,321,758 is described a programmable analogue hearing aid with multiple frequency bands. When the hearing aid is fitted, the various frequency bands may be attenuated individually. The sum of these individual frequency bands are amplified in an analogue output stage. For the purpose of achieving a desired overall gain of the hearing aid the analogue output signal from the output stage may also be attenuated. This last attenuation is fixed once in the fitting procedure for the hearing aid, and is not changed, unless the hearing aid is fitted anew. This attenuation is achieved by means of a number of resistors which may be connected in parallel with each others between the output of the amplifier and the receiver, ie. in series with the impedance of receiver. The receiver may also be connected directly to the output of the amplifier by short circuiting of all the resistors. Apart from the fact that this way of attenuation also incurs losses, it is further undesirable because the output characteristic of the receiver compared to a solution using a voltage divider will be more dependent on the impedance of the receiver, which may not be linear but depend on frequency.

Contrary to the above mentioned analogue amplifiers digital amplifiers, known as class D or switch mode amplifiers, may, in principle, be made practically loss free. They are therefore often used where there is a need for high efficiency of the amplifier, eg. in battery powered hearing aids. In such amplifiers a fixed voltage level is switched in pulses. The impedance of the receiver receives the full supply voltage during these pulses, giving rise to a current. To achieve a specific output signal the pulses are modulated to give a mean current corresponding to the desired signal. Because the output level may be regulated entirely by adapting the switching cycles there it has never been suggested to use voltage dividers in connection with digital amplifiers as this would compromise the desired high efficiency of the amplifier.

SUMMARY OF THE INVENTION

It is an object to provide a hearing aid in which has a dynamic range suited for in-situ fitting, and which overcomes the drawbacks mentioned above.

This object is achieved by splitting the dynamic range of the amplifier into two overlapping reduced ranges, ie. a range for normal use covering eg. from 40 to 130 dB SPL and a low noise range covering eg. from 0 to 90 dB SPL.

In an embodiment according to the invention, this object is achieved with a hearing aid system for the in-situ fitting of hearing aids, said system comprising a separate control device, and at least one hearing aid, adapted for communication with each other, said hearing aid comprising at least one microphone, a signal processor for generating an output signal to a receiver, and means for receiving control signals and power from the control device, and said control device being in communication with said hearing aid during the in-situ fitting for the activation of generation of test signals, which test signals are delivered to said receiver and emitted therefrom as acoustic test signals, wherein said hearing aid further comprises a switch means which when said hearing aid is in communication with the control device therefrom may optionally be switched between at least a first and a second position, said switch attenuating in the first position the output signal to the receiver using a voltage dividing resistor network, and said switch bypassing in the second position said voltage dividing resistor network so as not to influence the output signal to the receiver.

The provision of the voltage dividing resistor network allows for operating the hearing aid in two different modes ie. a normal mode and a low noise mode using the one and the same amplifier.

The enlarged dynamic range is then achieved by bypassing the voltage divider in all situations where the enlarged dynamic range is not needed, in particular in normal use of the hearing aid, using only the dynamic range of the amplifier itself, and in situations where the enlarged dynamic range is needed, to use the voltage dividing resistor network to attenuate the output signal from the amplifier, thereby also attenuating the inherent noise of the amplifier.

Since the voltage dividing resistor network is bypassed in all situations except during fitting, the losses incurred by the resistors are of less importance. In particular, they are of absolutely no importance in the case where the control device for the in situ fitting provides the power supply for the hearing aid, which is thus not drawing any power from the limited battery supply.

According to another aspect of the invention the connection between the control box and the hearing aid may, in cases where the control box is not intended to serve as power supply for the hearing aid during the in-situ fitting, take the form of a cordless connection.

A particular aspect of the present invention is the use of a voltage dividing network in connection with a digital amplifier in a hearing aid adapted for in-situ fitting.

The voltage dividing network may according to one embodiment attenuate the output signal from the digital amplifier, or according to another embodiment, attenuate the supply voltage for the digital amplifier.

BRIEF DESCRIPTION OF THE DRAWINGS

The invention will now be described by way of nonlimiting examples of embodiments, and in connection with the figures.

In the figures

DETAILED DESCRIPTION OF THE INVENTION

Figure 1:
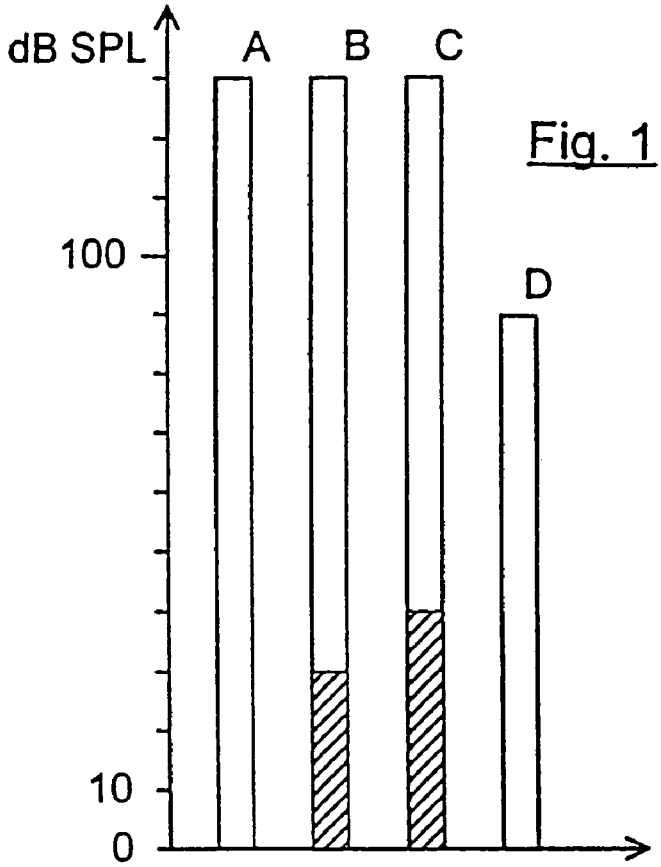
FIG. 1 shows different dynamic ranges.

FIG. 1 shows different dynamic ranges. The column A shows a desired dynamic range of 130 dB SPL. Column B shows typical dynamic range of 100 dB SPL, as can be achieved with most common amplifiers. Column C shows a slightly narrower dynamic range covering the 90 dB from 40 dB to 130 dB. Column D shows another dynamic range of 90 dB, but covering instead from 0 dB to 90 dB, as may be achieved by attenuating the dynamic range of column C by 40 dB. It can be seen that the overlapping dynamic ranges of column C and D will in conjunction provide the desired dynamic range of column A.

Figure 2A:
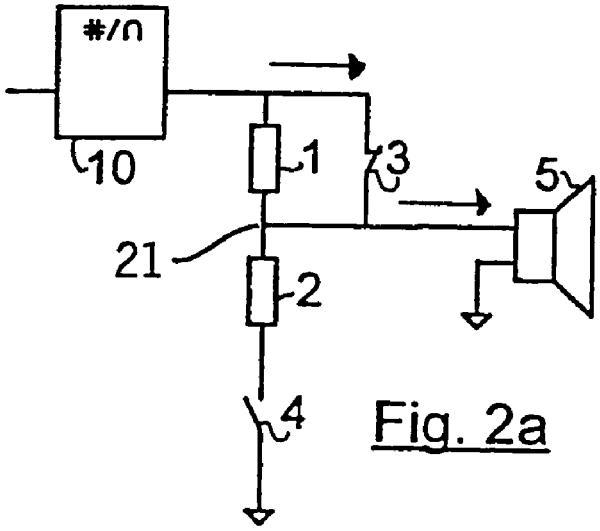
FIG. 2*a* shows as a diagram an embodiment of the present invention in the normal mode in which the voltage dividing resistor network is bypassed.
Figure 2B:
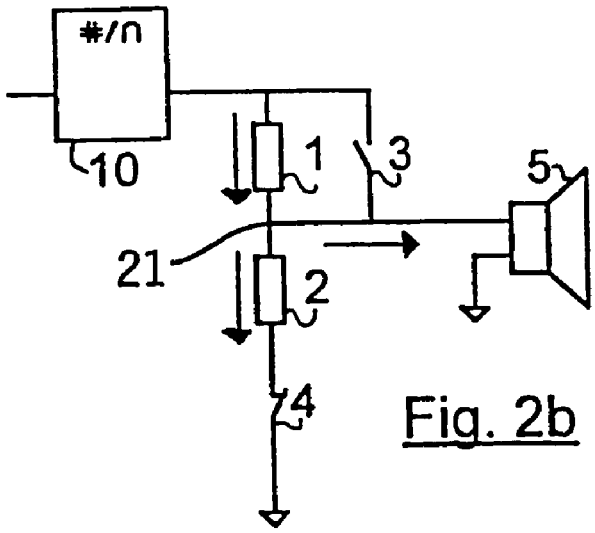
FIG. 2*b* shows the same embodiment as in FIG. 2*a*, but in the low noise mode in which the voltage dividing resistor network is not bypassed.

FIGS. 2*a* and 2*b* shows an exemplary embodiment of the present invention. The embodiment incorporates a amplifier, of which only the final stage is shown. In the embodiment shown in FIGS. 2*a* and 2*b* the final stage is a digital/analogue converter 10 of a digital hearing aid, but in principle it could also be the output stage of a fully analogue amplifier or of a switch mode or class D amplifier. To the digital/analog converter 10 is connected a voltage dividing resistor network comprising two resistors 1 and 2, as well as the receiver 5 of the hearing aid. The current through the resistors 1 and 2, is controlled by two switches 3 and 4. Switch 3 being a normally closed switch and switch 4 being a normally open switch. The current flow is indicated with arrows in all of FIGS. 2*a* to 4*f*.

In FIG. 2*a* the normally closed switch 3 short circuits resistor 1 so that the signal from the digital/analogue converter is fed directly to the receiver 5. The normally open switch 4 prevents the resistor 2 from drawing any current from the digital/analogue converter 10. This diagram represents the hearing aid in normal use, ie. the normal mode.

In FIG. 2*b* is shown the diagram representing the hearing aid in the low noise mode, eg. during the in-situ fitting. In this situation the normally closed switch 3 is open and the normally open switch 4 is closed. The current from the digital/analogue converter 10 thus flows though the resistor 1 of the voltage divider and from the tap 21 of the voltage divider partly through the receiver partly through the resistor 2. Hereby the signal to the receiver 5 is attenuated compared with the situation in FIG. 2*a*. Since the signal includes the inherent amplifier noise this noise ia also attenuated.

The current flowing through the resistors 1 and 2 give rise to power loss, but as explained earlier, this is only temporarily during the in-situ fitting, where the power for the hearing aid is often provided by the control box 16. Thus, the power loss is of less or no importance.

Instead of attenuating the output of a digital or class D amplifier as described above, it is in such an amplifier also possible to attenuate the power supply, ie. the supply voltage $U_{CC}$, as will be described in the following.

Figure 3:
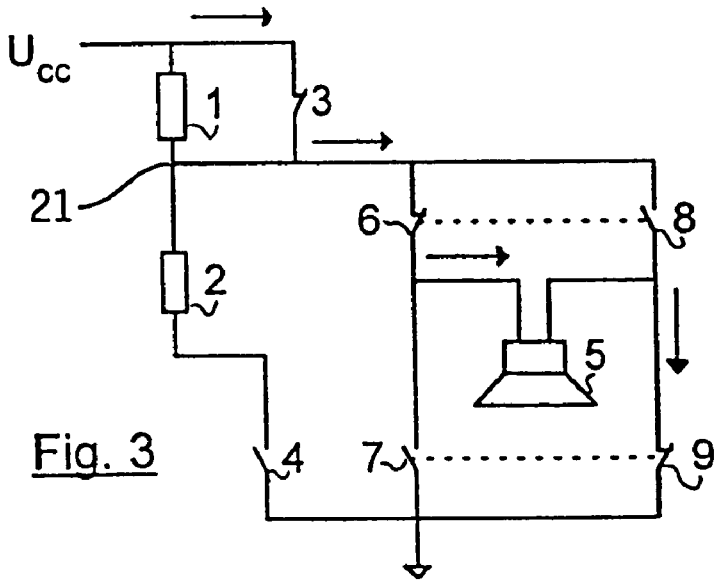
FIG. 3 shows as a diagram a second embodiment of the present invention.

In FIG. 3 is shown an embodiment using a fully digital amplifier of the switch mode type, eg. a class D amplifier. This embodiment is shown in the normal mode only. The use of such a digital amplifier is highly desirable in modern hearing aids because they are generally already digital, ie. using digital signal processing, such as filtering, and because of the high efficiency.

In such a D class amplifier the output current to the receiver 5 is, as mentioned above, not delivered as an analogue signal, but instead as a sequence of high frequency square pulses with alternating positive and negative pulses with a fixed amplitude and a fixed cycle length. The frequency can be several orders of magnitudes higher than the audible frequency which is to be amplified. By regulating the relationship between the width of the positive and negative pulse within the fixed cycle length the mean current in the output signal may be controlled to achieve the desired output signal. This is commonly known as pulse width modulation.

Alternatively the desired output current is achieved by supplying a pulse train of positive or negative pulses of fixed amplitude and length. By variation of the sequence in which the positive or negative pulses appear after each other the mean output current can be regulated. This is commonly known as bit stream modulation.

The embodiment of FIG. 3 allows for the use of any of these principles as well as others eg. puls duration/density modulation PDM. The supply voltage $U_{CC}$ in the position shown in FIG. 3 is fed through the normally closed switch 3 to the modulating part of the amplifier. The modulating part of the amplifier comprises a first pair of coupled modulating switches 6, 8, a second pair of coupled modulating switches 7, 9 and the receiver 5. The two pairs modulating switches are controlled to give a current of the desired polarity through the receiver 5 in accordance with the above principles. In the situation shown the current will flow from the left to the right through the receiver in the diagram as indicated by arrows. To achieve a current of the opposite polarity the switches 6 and 9 are opened and the switches 7 and 8 closed. It may also be possible to achieve zero current through the receiver 5 by opening all four switches 6 to 9.

In such class D amplifiers it is for a given clock frequency and supply voltage difficult to achieve a low inherent noise because of the discrete square signals with a fixed amplitude is used. To achieve lower noise levels a higher clock frequency or a lower supply voltage must be used.

According to the present invention this low noise mode, which may be necessary in connection with the in-situ fitting of hearing aids with persons having normal hearing in at least some frequency bands, is achieved by attenuating the supply voltage $U_{CC}$.

This is achieved by switching the normally closed switch 3 and the normally open switch 4 to the opposite position of those shown. In this case current will flow through the voltage dividing network comprising the resistors 1 and 2, and the divided supply voltage tapped at the node 21 may be used as supply voltage instead of $U_{CC}$. To achieve the desired output, the modulating switches 6 to 9 must of course be controlled at different switching rates compared with the same signal level in the normal mode, because the reduced supply voltage has to be taken into consideration.

Figure 4A:
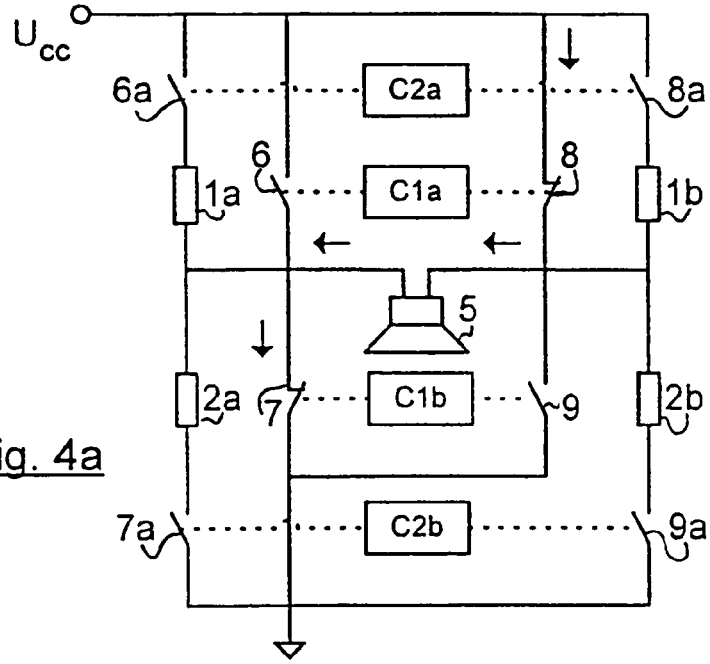
FIG. 4*a* shows as a diagram a third embodiment of the present invention in the normal mode and with a first polarity of current through the receiver.
Figure 4B:
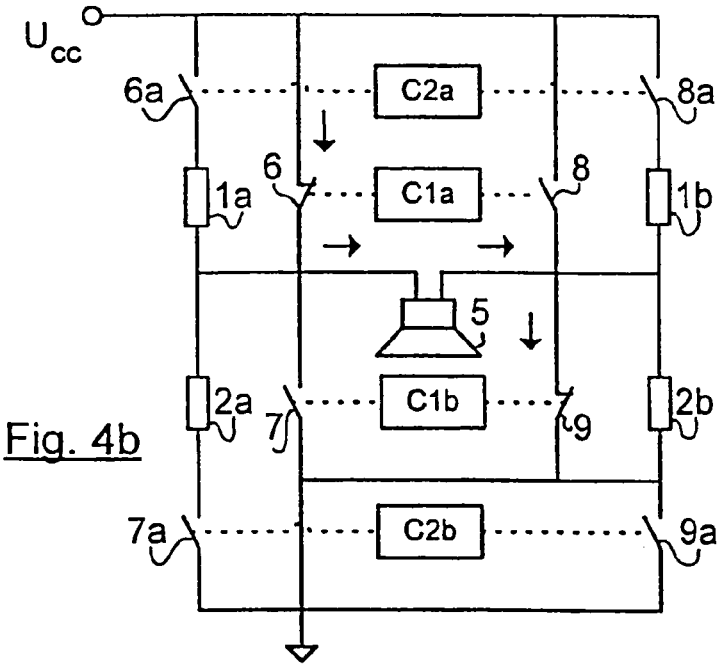
FIG. 4*b* shows the third embodiment, but with the opposite polarity of the current through the receiver, compared to FIG. 4*a*.
Figure 4C:
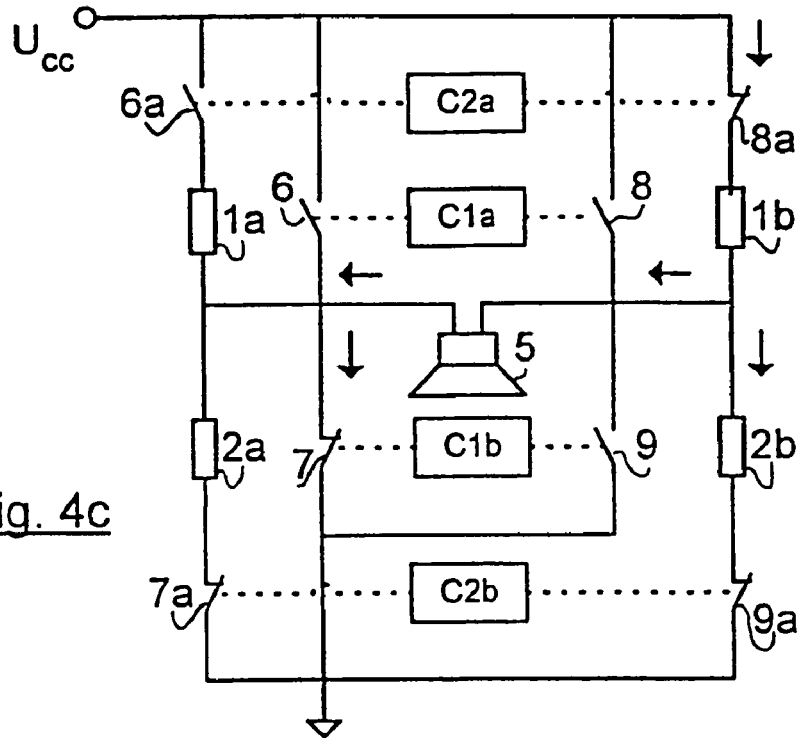
FIG. 4*c* shows the third embodiment, with the same polarity of the current through the receiver as in FIG. 4*b*, but in a low noise mode.
Figure 4D:
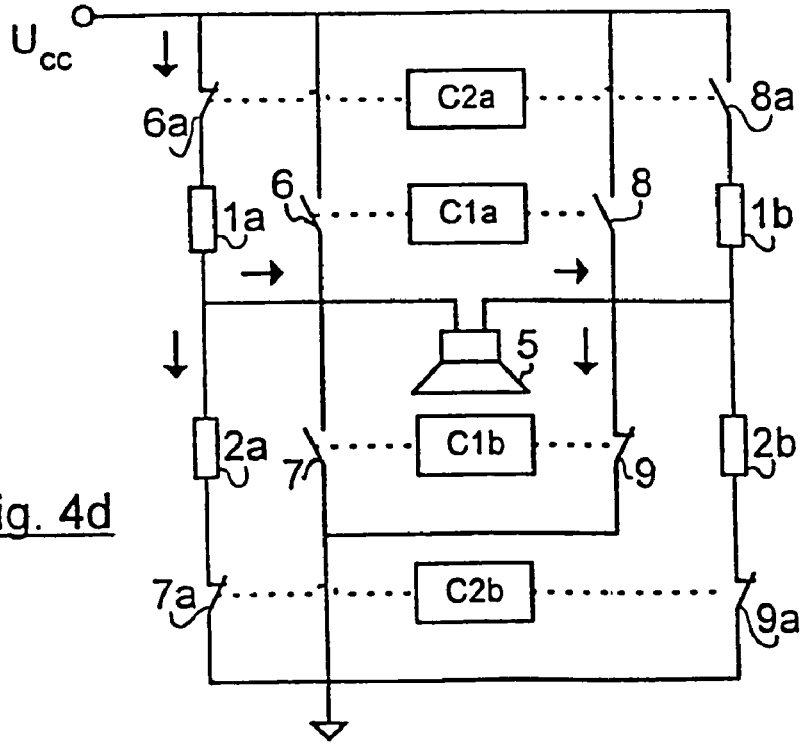
FIG. 4*d* shows the third embodiment, with the same polarity of the current through the receiver as in FIG. 4*b*, but in a low noise mode.
Figure 4E:
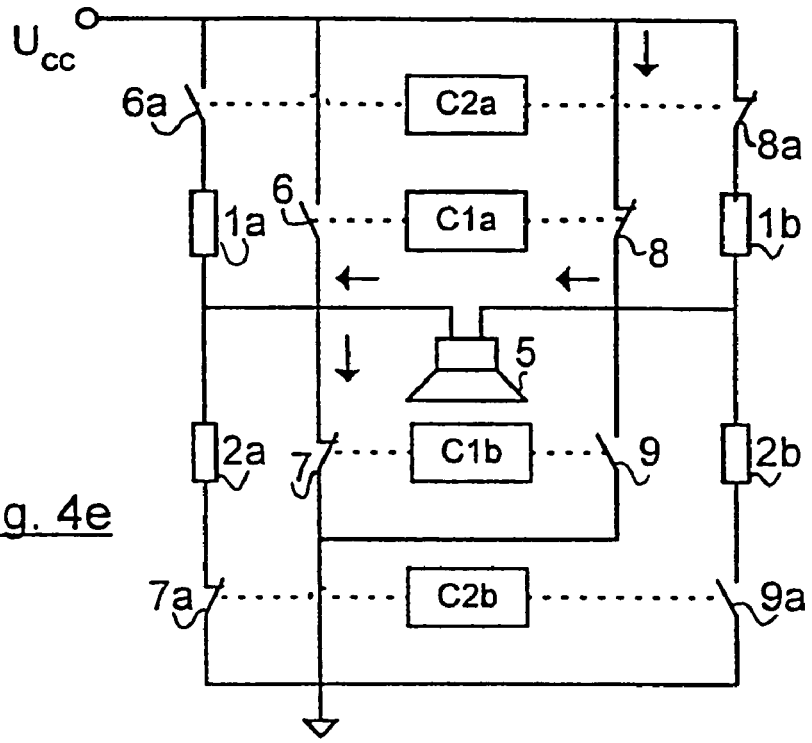
FIG. 4*e* shows a different way of operating the modulating switches in the third embodiment in the normal mode.
Figure 4F:
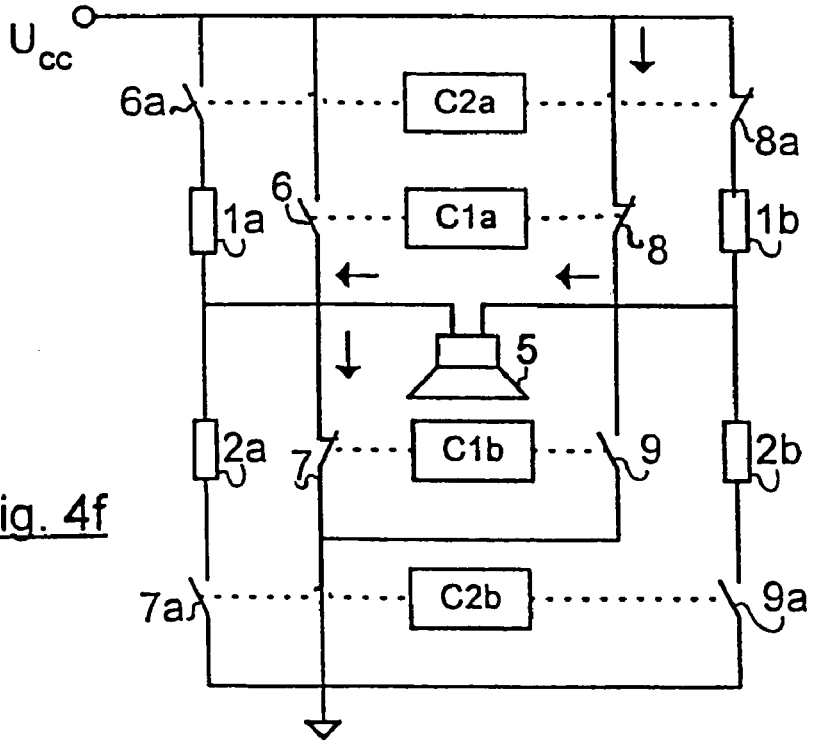
FIG. 4*f* shows a different way of operating the modulating switches in the third embodiment in the normal mode but with the opposite polarity of the current through the receiver compared to FIG. 4*e*.

In another embodiment according to FIGS. 4*a* to 4*f*, there may instead of one voltage divider and a one pair of switches 3 and 4 used to bypass it or engage it, respectively, be used two sets of modulating switches. A first set of modulating switches 6 to 9, and a second set of modulating switches 6*a* to 9*a*. The first modulating switches 6 to 9 modulate the supply current $U_{CC}$ under normal use in the manner described above. During this, the second modulating switches 6*a* to 9*a* may all be open as shown in FIGS. 4*a* and 4*b*, or they may all be operated in synchronicity with the first modulating switches 6 to 9, as shown in FIGS. 4*e* and 4*f*.

In FIGS. 4*a* and 4*b* there is shown one way of operating the modulating switches 6 to 9 in the normal mode. In the normal mode the switches 6*a* to 9*a* which are normally open switches are in the open position, allowing no current to flow through the resistors 1*a*, 1*b*; 2*a*, 2*b*. The modulating switches are operated between the alternate positions shown in FIGS. 4*a*, 4*b* respectively, so as to let current flow through the receiver 5 in alternate directions. If desired, it may also be possible to open all of the modulating switches or at least the modulating switches 6 and 8 to achieve a third state of zero current through the receiver 5.

Referring now to FIGS. 4*c* and 4*d*, when the lower end of the dynamic range, ie. the low noise mode, is needed during the in-situ fitting, the modulating switches 6 and 8 are opened and the modulation of the current is instead effected by means of the modulating switches 6*a* and 8*a* in the same manner as described above. The switches 7*a* and 9*a* may be closed during this low noise mode or be operated synchronously with the switches 6*a* and 8*a*, ie. 7*a* closing and opening 7*a* synchronously with 6*a* and 9*a* synchronously with 8*a*, respectively. As indicated by arrows in FIGS. 4*c* and 4*d* current flows in FIG. 4*c* through a first voltage divider comprising the resistors 1*b*, 2*b*, and the impedance of the receiver 5. In FIG. 4*d* the modulating switches are in their opposite position compared with FIG. 4*c*, and the current flows through a second voltage divider comprising the resistors 1*a*, 2*a* and the impedance of the receiver 5. As it can be seen the current flows through the receiver 5 in the opposite direction, ie. gives rise to a pulse of opposite polarity of the one in FIG. 4*c*. In this mode it is of course also possible to open all of the modulating switches, or at least the modulating switches 6*a*, 8*a* or 7*a*, 9*a*, respectively, so as to achieve a zero current state.

FIGS. 4*e* and 4*f* indicate a different way of operating the modulating switches in the normal mode compared to FIGS. 4*a* and 4*b*. Instead of using the switches 6*a* to 9*a* as normally open switches, the switches 6*a* to 9*a* are moved in phase with the modulating switches 6 to 9. In this case the resistors 1*a*, 2*a*; 1*b*, 2*b* are either currentless because the switch in series with them is open, or because they are short circuited by the respective modulating switch in parallel with them.

In principle it is also possible with the configuration shown in FIGS. 4*a* to 4*f* to achieve a modulation with 5 levels, ie. full negative, divided negative, zero, divided positive, and full positive, provided that the switches are controlled accordingly.

The switches in all of the embodiments are implemented as electronic switches, eg. semiconductor switches. The control of these switches are known per se, and is merely indicated by the blocks C1*a*, C2*a*, C1*b*, C2*b* in FIGS. 4*a* to 4*f*.

In a full digital hearing aid the control of the switches may be in accordance with the principles of the amplifier type known as Σ−Δconverter, e.g. as the one described in U.S. Pat. No. 5,878,146.

Figure 5:
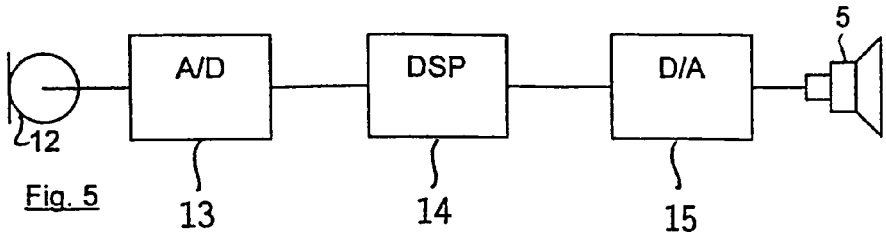
FIG. 5 shows an exemplary block diagram of a hearing aid.

In FIG. 5 is schematically shown an embodiment digital hearing aid, comprising a pickup or microphone 12 for converting an analogue acoustic signal to an analogue electric signal. The analogue electric signal is digitized in the analogue/digital converter 13 and delivered to a digital signal processor (DSP) 14. From the digital signal processor 14 the signal is delivered to a digital/analogue, which may be a separate element as described in connection with FIGS. 2*a* and 2*b* or it may be the switch mode amplifier itself as described in connection with FIG. 3 or 4*a* to 4*f*.

Figure 6:
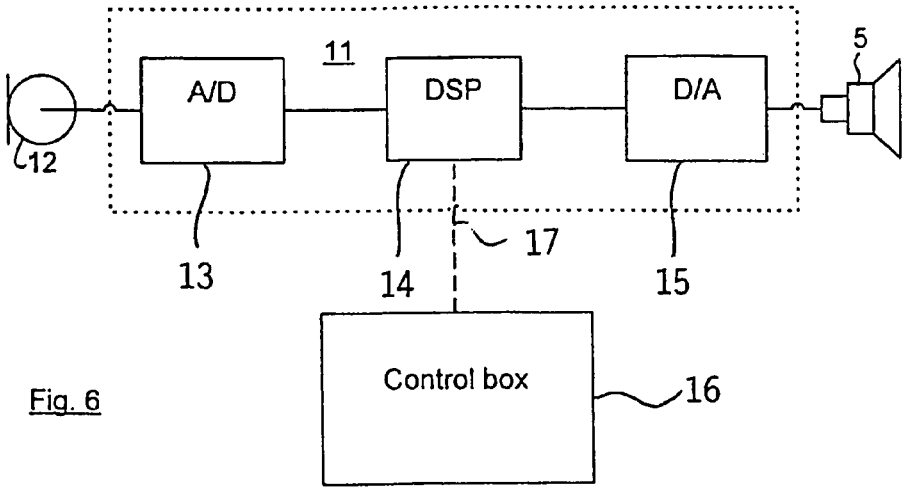
FIG. 6 shows an exemplary block diagram of a hearing aid with connected control box.

FIG. 6 shows schematically an embodiment of a hearing aid adapted for in-situ fitting. For this purpose a control box 16 is connected to the digital signal processor 14 via a control line 17. The control box 16 delivers test signals or controls the generation of test signals, by the digital signal processor 14.

Figure 7:
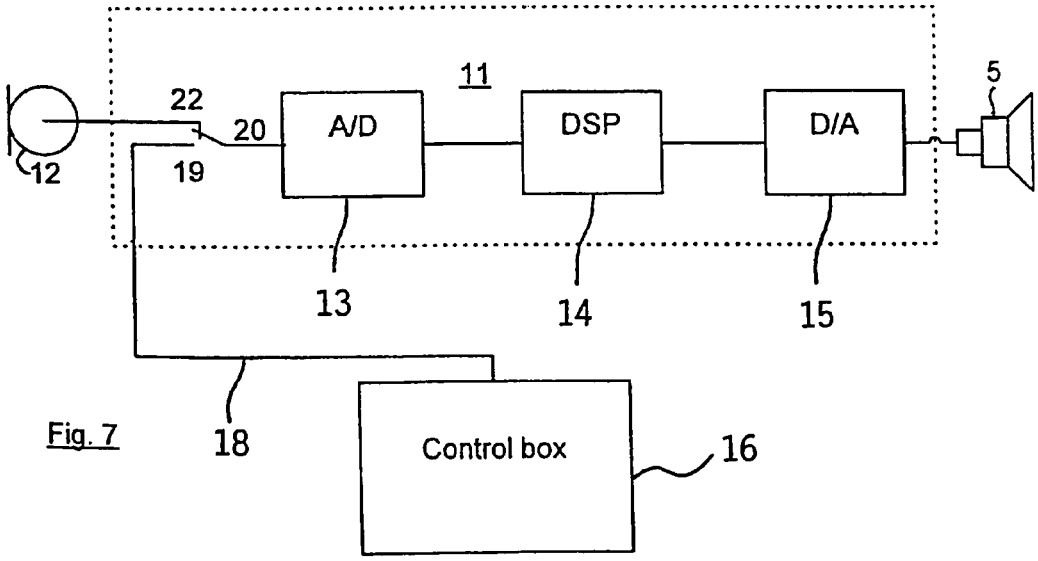
FIG. 7 shows another exemplary block diagram of a hearing aid with connected control box.

FIG. 7 schematically shows an embodiment of a hearing aid also adapted for in-situ fitting. In this case the control box 16 is connected to the analogue/digital converter 13 of the hearing aid via a selector switch 20. In the case shown the selector switch 20 is in a position 22 where it delivers the signal from the microphone 12 to the input of the analogue/digital converter 13. If in-situ fitting is desired, the selector switch 20 is moved to eg. the position 19, thereby interrupting the signal from the microphone, and delivering instead the signals from the control box 16 to the analogue/digital converter 13 via the line 17.

In both of the embodiments of FIGS. 6 and 7 the control box 16 also provide the power for operating the hearing aid during the in-situ fitting.

The control box may eg. be as described in U.S. Pat. No. 5,710,819.

If the hearing aid is only to be power supplied via the built-in battery, and not externally from the control box 16, the connection between the control box 16 and the hearing aid may be a cordless connection as indicated by the stapled line 17 in FIG. 6, such as an infrared link from the control box 16 to the hearing aid. This is particularly advantageous when the hearing aid itself generates the test signals based on control signals from the control box 16.

Since the enlarged dynamic range A is achieved by two overlapping dynamic ranges C, D each used for a specific situation, it is not necessary to have any adjustment possibility for the attenuation as such. The attenuation can therefore advantageously be achieved with a fixed value only, because this allows for using fixed value resistors 1, 2; 1*a*, 2*a*; 1*b*, 2*b*, in the voltage dividing network.

The invention claimed is:

1. A hearing aid system for in-situ fitting of hearing aids, said system comprising a hearing aid, said hearing aid having a microphone, a signal processor for processing an output from said microphone, a digital amplifier for amplifying an output from said signal processor, an output transducer for converting into sound an output from said digital amplifier, and a control signal receiver means, a control device, said control device being adapted for communication with said control signal receiver means for selective generation and feeding of a test signal to said output transducer a voltage dividing network adapted to cooperate with said digital amplifier so as to attenuate said test signal as fed to said output transducer, and switch means for optionally switching between a first position and a second position, said switch means acting in said first position to connect said voltage dividing network to attenuate said test signal, and said switch means acting in said second position to bypass said voltage dividing network in order to feed said test signal directly to said output transducer.

2. The hearing aid system according to claim 1, wherein said control device is adapted to supply power to said hearing aid while said control device is in communication with said hearing aid.

3. The hearing aid system according to claim 1, wherein said control device is adapted for communication with said control signal receiver means by way of a cordless connection.

4. The hearing aid system according to claim 1, wherein said voltage dividing network comprises at least two fixed value resistors.

5. The hearing aid system according to claim 1, wherein said digital amplifier comprises a digital/analogue converter.

6. The hearing aid system according to claim 5, wherein said digital/analogue converter comprises a sigma-delta converter.

7. The hearing aid system according to claim 1, wherein said digital amplifier comprises a switching amplifier.

8. The hearing aid system according to claim 1, wherein said digital amplifier comprises a bit-stream converter.

9. The hearing aid system according to claim 1, wherein said voltage dividing network is connected to receive an output from said digital amplifier and to feed to said output transducer an attenuated version of said test signal.

10. The hearing aid according to claim 1, wherein said voltage dividing network is connected to attenuate a supply voltage for said digital amplifier.

11. A hearing aid adapted for in-situ fitting with the hearing aid acting as an audio signal source, said hearing aid comprising a digital amplifier, attenuation means and an output transducer, said attenuation means comprising a voltage dividing resistor network of fixed value resistors, said hearing aid being adapted for selective operation in a first mode and a second mode, said hearing aid being adapted to operate in said first mode to generate by said digital amplifier an amplifier output signal within a first dynamic range extending between an amplifier noise level and a maximum output level, and said hearing aid being adapted to operate in said second mode to feed to said digital amplifier a test signal, and to generate by said digital amplifier and said attenuation means an amplifier output signal within a second dynamic range, which second dynamic range is shifted to lower levels relative to said first dynamic range.

12. The hearing aid according to claim 11, wherein said digital amplifier is a switch mode amplifier, and wherein said attenuation means comprises means for attenuating a supply voltage for said digital amplifier.

13. The hearing aid according to claim 11, wherein said attenuation means comprises means for attenuating an output signal from said digital amplifier.

14. The hearing aid according to claim 11, comprising a microphone and a selector switch, which selector switch is adapted to selectively connect said microphone to, or disconnect said microphone from, said digital amplifier.

* * * * *